US009986364B2

(12) United States Patent
Wong

(10) Patent No.: US 9,986,364 B2
(45) Date of Patent: May 29, 2018

(54) ENDPOINT MIXING SYSTEM AND PLAYING METHOD THEREOF

(71) Applicant: Sub-intelligence Robotics (SIR) Corporation (Hong Kong) Limited, Hong Kong (HK)

(72) Inventor: Wai Ming Wong, Hong Kong (HK)

(73) Assignee: Siremix GmbH, Berlin (DE)

( * ) Notice: Subject to any disclaimer, the term of this patent is extended or adjusted under 35 U.S.C. 154(b) by 0 days. days.

(21) Appl. No.: 15/306,998

(22) PCT Filed: Mar. 13, 2015

(86) PCT No.: PCT/CN2015/074243
§ 371 (c)(1),
(2) Date: Oct. 26, 2016

(87) PCT Pub. No.: WO2015/169124
PCT Pub. Date: Nov. 12, 2015

(65) Prior Publication Data

US 2017/0055100 A1 Feb. 23, 2017

(30) Foreign Application Priority Data

May 8, 2014 (HK) ..... 14104355

(51) Int. Cl.
*H04R 29/00* (2006.01)
*H04R 3/12* (2006.01)
(Continued)

(52) U.S. Cl.
CPC ..... *H04S 7/305* (2013.01); *H04S 7/30* (2013.01); *H04S 7/301* (2013.01); *H04R 1/028* (2013.01);
(Continued)

(58) Field of Classification Search
None
See application file for complete search history.

(56) References Cited

U.S. PATENT DOCUMENTS

2006/0083218 A1* 4/2006 Sako ..... A61B 5/024 370/352
2006/0224261 A1 10/2006 Asada et al.
(Continued)

OTHER PUBLICATIONS

D-BOX technologies inc. "The science on the D-BOX movie theater experience" https://www.youtube.com/watch?v=iBbEaEUqtnY, Mar. 17, 2010.*
(Continued)

*Primary Examiner* — Curtis Kuntz
*Assistant Examiner* — Qin Zhu

(57) ABSTRACT

The present invention provides an endpoint mixing (EM) system and playing method. The EM playing method includes the following steps: S0) providing a plurality of microphones corresponding to a plurality of sounding bodies in an initial environment, an endpoint environment of which the type and size correspond to those of the initial environment, a plurality of sound simulation devices, and a motion tracking device; S1) a plurality of microphones synchronously recording the sounds of a plurality of corresponding sounding bodies into audio tracks respectively; the motion tracking device synchronously recording the motion states of a plurality of sounding bodies into motion state files; S2) a plurality of sound simulation devices synchronously moving in the motion states of the corresponding sounding bodies recorded in the motion state files, and synchronously playing the audio tracks recorded by the corresponding microphones respectively, thereby playing EM.

6 Claims, 4 Drawing Sheets

(51) Int. Cl.

| | |
|---|---|
| ***H04R 1/02*** | (2006.01) |
| ***H04R 5/02*** | (2006.01) |
| ***H04S 7/00*** | (2006.01) |
| ***H04S 3/00*** | (2006.01) |
| ***H04S 1/00*** | (2006.01) |

(52) U.S. Cl.

CPC ..... *H04R 3/12* (2013.01); *H04R 5/02* (2013.01); *H04R 29/005* (2013.01); *H04R 2201/021* (2013.01); *H04S 1/00* (2013.01); *H04S 3/00* (2013.01); *H04S 2400/15* (2013.01)

(56) References Cited

U.S. PATENT DOCUMENTS

2006/0246814 A1* 11/2006 Todokoro ..... A63H 5/00 446/81
2007/0042673 A1* 2/2007 Ishihara ..... A63H 11/00 446/409
2007/0147644 A1* 6/2007 Bodley ..... H04B 1/38 381/334
2007/0183618 A1* 8/2007 Ishii ..... H04R 3/12 381/387
2008/0304677 A1* 12/2008 Abolfathi ..... G10K 11/1788 381/71.1
2009/0238378 A1* 9/2009 Kikinis ..... H04N 13/0497 381/92
2011/0010013 A1* 1/2011 Ruan ..... B25J 5/007 700/261
2012/0099594 A1* 4/2012 Lau ..... H04L 12/2807 370/392
2012/0306907 A1 12/2012 Huston
2013/0041648 A1* 2/2013 Osman ..... H04S 7/304 704/2
2014/0133683 A1* 5/2014 Robinson ..... H04S 3/008 381/303
2015/0208156 A1* 7/2015 Virolainen ..... H04S 7/303 381/92
2015/0319540 A1* 11/2015 Rubinstein ..... H04R 23/008 381/172
2015/0358752 A1* 12/2015 Orman ..... G01S 3/8022 381/56

OTHER PUBLICATIONS

Search Report of Hong Kong Short-term Patent Application No. 14104355.5 dated May 30, 2014.

* cited by examiner

ENDPOINT MIXING SYSTEM AND PLAYING METHOD THEREOF

TECHNICAL FIELD

The present invention relates to an endpoint mixing (EM) system for capture, transmission, storage and reproduction of sounds, and further relates to an EM playing method.

DESCRIPTION OF THE BACKGROUND

The current concert recording is unable to realize the stereo effect of live concerts. The listeners of the recording are unable to have a feeling as if personally on the scene of a concert. Meanwhile, the microphones adopted for recording of a concert are unable to completely record the details of all sounding bodies in the concert, and the recording of the concert cannot present all the details of single or multitudinous sounds of the live concert.

SUMMARY OF THE INVENTION

Current concert recording cannot realize the stereo effect of a live concert and cannot fully present all the details of the sounds in the live concert, particularly the details of the positions and motion loci of the sounding bodies during multi-source recording and replay. The present invention provides an EM system and an EM playing method, which can overcome the above problem.

The present invention provides the following technical solution to address the technical problem.

The present invention provides an EM playing method, comprising the following steps:

S0) providing a plurality of microphones corresponding to a plurality of sounding bodies in an initial environment; providing an endpoint environment of which the type and size correspond to those of the initial environment, and a plurality of sound simulation devices corresponding to a plurality of the microphones one to one and connected to the corresponding microphones in a communication manner; each of the sound simulation devices is disposed on an endpoint position in the endpoint environment to correspond to the position where the sounding body corresponding to the sound simulation device is located in the initial environment; providing a motion tracking device connected to a plurality of sound simulation devices in a communication manner;

S1) a plurality of microphones synchronously record the sounds of a plurality of corresponding sounding bodies into audio tracks respectively; the motion tracking device synchronously records the motion states of a plurality of sounding bodies into motion state files;

S2) a plurality of sound simulation devices synchronously move in the motion states of the corresponding sounding bodies recorded in the motion state files, and synchronously play the audio tracks recorded by the corresponding microphones respectively, thereby playing EM.

In the foregoing EM playing method of the present invention, every microphone is opposite to the sounding body to which it corresponds, and the distance between every microphone and corresponding sounding body is the same.

In the foregoing EM playing method of the present invention, the sound simulation devices comprise speakers.

In the foregoing EM playing method of the present invention, some or all of the sound simulation devices are speaker robots; each of the speaker robots comprises robot wheels at the bottom of the speaker robot, and robot arms at the top of the speaker robot; the speakers are disposed on the hands of the robot arms.

Step S2 further comprises: the speaker robots move along the motion loci of corresponding sounding bodies recorded in the motion state files.

In the foregoing EM playing method of the present invention, all the sound simulation devices are speaker robots; each of the speaker robots comprises robot wheels at the bottom of the speaker robot and robot arms at the top of the speaker robot; the speakers are disposed on the hands of the robot arms.

Step S0 further comprises providing robotic furniture; the robotic furniture includes a movable ROBO chair that can carry audience and a movable ROBO stand holding up a video-playing display screen or projection screen.

Step S2 further comprises: synchronously moving the ROBO chair, ROBO stand and speaker robots in an endpoint environment, and maintain their relative positions.

In the foregoing EM playing method of the present invention, the speakers are disposed on motor-controlled guide rails in a slidable manner.

Step S2 further comprises: the speakers move on the rails along the motion loci of corresponding sounding bodies recorded in the motion state files.

In the foregoing EM playing method of the present invention, all speakers are linked together through WiFi.

In the foregoing EM playing method of the present invention, Step S1 further comprises: providing a sound modification device connected in a communication manner to some or all of a plurality of the microphones, and to the sound simulation devices corresponding to some or all of a plurality of the microphones; the sound modification device modifies the sound quality of the audio tracks respectively recorded by some or all of a plurality of the microphones or enhances sound effect to the audio tracks respectively recorded by some or all of a plurality of the microphones.

Step S2 further comprises: the sound simulation devices corresponding to some or all of a plurality of the microphones synchronously play corresponding audio tracks modified by the sound modification device.

In the foregoing EM playing method of the present invention, the audio tracks recorded by a plurality of the microphones are saved in a format of EMX file.

The present invention further provides an EM system. This EM system comprises a plurality of microphones to which a plurality of sounding bodies correspond in an initial environment and which are intended to synchronously record the sounds of the corresponding sounding bodies into audio tracks; a motion tracking device for synchronously recording the motion states of a plurality of sounding bodies into motion state files; an endpoint environment of which the type and size correspond to those of the initial environment; and a plurality of sound simulation devices. The sound simulation devices correspond to a plurality of the microphones one to one, connected in a communication manner to the corresponding microphones and the motion tracking device, synchronously move in the motion states of the corresponding sounding bodies recorded in the motion state files and synchronously play the audio tracks recorded by the corresponding microphones, thereby playing EM. Every sound simulation device is disposed on an endpoint position in the endpoint environment to correspond to the position where the sounding body corresponding to the sound simulation device is located in the initial environment.

The EM system and playing method of the present invention respectively record the sounds of a plurality of sounding bodies into audio tracks through a plurality of microphones, and play corresponding audio tracks through a plurality of speakers corresponding to the positions of the sounding bodies. It may reproduce the sounds played by sounding bodies on site and have a very good sound quality effect.

BRIEF DESCRIPTION OF THE DRAWINGS

Below the present invention will be further described by referring to the accompanying drawings and embodiments. Of the drawings.

DETAILED DESCRIPTION OF PREFERRED EMBODIMENTS

Definition: Natural sounds

Figure 1:
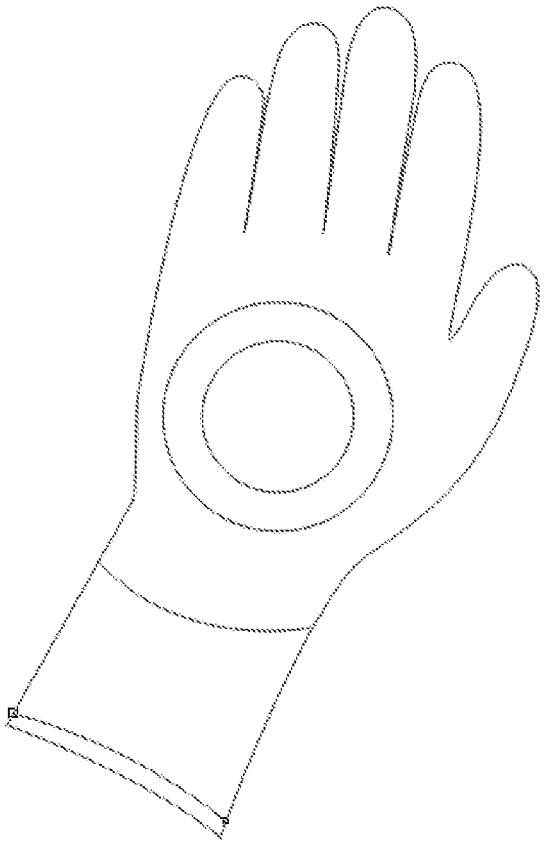
FIG. 1 is a schematic view of a palm speaker in an embodiment of an EM system of the present invention.

God creates the universe. Many objects or creatures may make sounds. Every sound has a unique 3D position in the space. Audition position is a kind of logical 3D coordinates used to set receivers (human ears for example).

An audience has one or a plurality of receivers and also has a few kinds of neural network structures. The acoustical signals captured by receivers will be transmitted to a neural network structure. The neural network structure conventionally is creature's brain and may form cognition and memory.

Supposing there is an audience, the process that the sounds of a plurality of sounding bodies nearby are directly transmitted to the receivers of the audience and meanwhile make the audience possess cognition and memory is defined as a First Order Mixing Process. The process that audition position, sound reflection and other factors will add extra features to resulting sound in the same time of the First Order Mixing Process is defined as a Second Order Mixing Process. The resulting sound in front of receivers will be captured and transmitted to the brain, thereby creating cognition and memory.

The formation process of the foregoing cognition and memory may be summarized into:

Sound waves sent by a sounding body→sound mixing process (First Order Mixing Process and Second Order Mixing Process)→resulting sound in front of a receiver→cognition and memory formed by audience's brain Definition: Microphone Microphone is a receiver and disposed on an audition position; in this way, acoustical signals can be captured by the microphone and converted into electronic signals, and then transmitted to a computer.

The foregoing process that acoustical signals are captured by a microphone and transmitted to a computer may be summarized into:

Sound waves sent by a sounding body→sound mixing process (First Order Mixing Process and Second Order Mixing Process)→resulting sound in front of a receiver→electronic signals According to the foregoing principles of natural sounds and microphones, the present invention provides an endpoint mixing (EM) system. This EM system comprises a plurality of microphones to which a plurality of sounding bodies correspond in an initial environment and which are intended to synchronously record the sounds of the corresponding sounding bodies into audio tracks; a motion tracking device for synchronously recording the motion states of a plurality of sounding bodies into motion state files; an endpoint environment of which the type and size correspond to those of the initial environment; and a plurality of sound simulation devices corresponding to a plurality of the microphones one to one, connected in a communication manner to the corresponding microphones and the motion tracking device, synchronously moving in the motion states of the corresponding sounding bodies recorded in the motion state files and synchronously playing the audio tracks recorded by the corresponding microphones, thereby playing EM; every sound simulation device is disposed on an endpoint position in the endpoint environment to correspond to the position where the sounding body corresponding to the sound simulation device is located in the initial environment.

What is EM (Endpoint Mixing)?

Microphone has two major uses: one is to record the sounds of a single sounding body; the other is to record the sounds of a specific environment.

For every audio track, EM is used to record the sound of a single sounding body, then convert electronic signals into digital audio and transmit this digital audio to a remote environment so as to replay it; or save this digital audio in a computer so as to replay it in the future.

A plurality of digital audio tracks can be replayed in a certain environment; in principle, in order to realize HiFi sound replay, each audio track is replayed only in one speaker.

However, in reality there are also some modifications, for example:

1. Two or more speakers are used to play one audio track;
2. If the recorded sounds of a specific environment or a sounding body are stereo, or stereo or surround effect is created during product recording in later stage, two or more speakers will be needed to play it. When there are two speakers (i.e.: logical left speaker and logical right speaker), stereo audio data can be naturally mapped to the logical left speaker and the logical right speaker; when there are more than two speakers, and the stereo audio data may be classified into left side audio data and right side audio data, it needs to be preset which speaker is used to replay left side audio data and which speaker is used to replay right side audio data. The arrangement of speakers replaying surround sound data is decided by surround sound technology.

The application of stereo recording and more than one speaker for reproducing sounding bodies can amplify acoustic images of sounding bodies to a large extent. In an EM system, the left channel is considered an audio track, the right channel is considered another audio track, and they keep independent during transmission and storage of audio data.

Endpoint refers to an environment for replaying audio tracks.

At an endpoint, EM introduces new features including use of existing speaker technology.

First of all, we introduce two dimensions of frequency spectrum developed by speakers.

1. Dimension 1: Speakers to some extent are changed from high summarization to high specialization;
2. Dimension 2: Speakers are changed from high summarization to high specialization by simulating specific sounding bodies.

Most of the speakers used at present are universal speakers. Hi-end HiFi systems are highly summarized and can play a very wide vocal range with high orders of magnitude and high quality. On the other hand, a speaker comprises a large number of speaker units to cover different vocal ranges.

Nevertheless, imitating specific sounding bodies by sound playback devices (or speakers) is a new method introduced by EM.

Imitate Sounding Bodies

We don't know rocks per se can generate sounds, but we know most objects in the nature can make sounds, such as: birds, leaves, wind, water and thunder. Human beings are also sounding bodies and can create musical instruments and use them to make unique sounds.

In human history, for easy management, sounding bodies are classified. We identify the features of every category to name them, such as: brass-wind instruments, saxophone, alto saxophone, female singer Whitney Houston, birds and nightingales.

The present application intends to make a sounding device to imitate a type of specific sounding bodies or single sounding bodies. For example, the proposed technology development direction of the present application is to simulate the following sounding bodies:

Birds, nightingales, leaves, bees, whales, waterfalls, brass-wind instruments, string instruments, pianos, violins, electric guitars and female voices.

After narrowing of the technology development direction, the following sounding bodies may be simulated:

Yanagisawa-990 alto saxophone and individual voices, such as: Whitney Houston.

The present application reveals all potentials that EM can realize, and points out its technology development direction.

However, the scope of the present application also determines the demarcation of EM system and speaker.

Record Sounds of Single Sounding Bodies

Before and during recording, the information of the following real (virtual) dais is captured:

GPS position; altitude; compass direction and angle of the dais (the orientation of the dais is the reverse direction of the orientation of real (or virtual) audiences).

During EM recording for a single target sounding body, the key point is to eliminate the abovementioned second order mixing process; audition position, sound reflection and other factors will make the recorded sounds completely different from the sounds of the target sounding object. In other words, EM recording for a single target sounding body focuses on recording all the details of initial sounds in a high resolution.

The current recording in studios or multi-audio track recording using linear signals of individual stage microphones or electronic musical instruments during live show can satisfy the foregoing key point.

In addition to sounds, the recording process also turns the information about synchronization between the sounding body and the audio capture activity at a reasonable frequency in the whole recording period into data. The data includes without limitation:

Audition position relative to a fixed reference point in a 3D space; orientation of every sounding body.

In this embodiment, every microphone is opposite to the sounding body to which it corresponds, and the distance between every microphone and corresponding sounding body is same.

It should be understood that a microphone and the sounding body to which it corresponds are not limited to being opposite to each other. Alternatively, the orientation of a microphone forms a specific angle with the sounding body to which it corresponds.

Definition: Real Time vs Time Shift

Recorded audio data is transmitted to an endpoint mainly in the following two ways:

1. Real time
2. Time shift

Some techniques all apply the concept of time shift, including use of computer files, storage, forwarding and on-demand playback. In the present application, when we use time shift, we use all these techniques.

Four Forms of EM

The first form of EM: For EM of a plurality of synchronous sounding bodies all in fixed positions It is supposed that in the recording time, all sounding bodies make sounds in a same time, and every sounding body has a fixed position in a 3D space; for example, in a concert held on seaside or an orchestral show in an auditorium, every musician is in a fixed position. Here, the purpose of EM is to establish an endpoint that can simulate an initial environment and all the sounds relevant with this initial environment; specifically, EM emphasizes accurate replay of the sounds of all singers and musical instruments at the endpoint. The replay process may be real time or time shift.

The endpoint in the first form has the following features:

1. The endpoint is an endpoint environment of which the type and size correspond to those of the initial environment
2. The endpoint comprises sound simulation devices for simulating initial sounding bodies; for example, the endpoint comprises hi-end HiFi systems and hi-end speakers, or comprises HiFi systems and specialized speakers suitable for a specific vocal range;
3. Every sound simulation device is disposed in an endpoint position in the endpoint environment to correspond to the fixed position where the sounding body is located in the initial environment.

For example, in a concert held on seaside, the sounding body is a band. The band comprises a plurality of guitars, such as: a bass guitar, a first electric guitar, a second electric guitar and acoustic guitar, and further comprises keyboard instruments, drums and singers.

The endpoint for simulating a live concert held on seaside should have the following features:

1. The endpoint environment and the initial environment are a same seaside. The direction of the sound simulation devices relative to the sea is same as the direction of the band relative to the sea;
2. The sound simulation devices include guitar voice boxes, stereo speakers, drumbeat simulation speakers and singing simulation speakers;
3. In the endpoint environment, a plurality of guitar voice boxes simulate a plurality of guitars one to one;
4. As hum is usually mingled during simulation of the sounds of keyboard instruments, stereo speakers are used in the endpoint environment to simulate the keyboard instruments;

5. In the endpoint environment, drums are simulated by drumbeat simulation speakers;
6. In the endpoint environment, singing is simulated by singing simulation speakers;
7. Every sound simulation device is disposed in an endpoint position same as the fixed position where the sounding body is located in the endpoint environment (i.e.: initial environment).

In an alternative embodiment, in an orchestral show held in an auditorium, the sounding bodies are a plurality of musical instruments;

The endpoint for simulating an orchestral show held in an auditorium should have the following features:

1. The endpoint environment is an auditorium of which the type and size correspond to those of the initial environment;
2. The sound simulation devices include a plurality of specialized speakers (or hi-end HiFi systems), which simulate a plurality of musical instruments one to one;
3. All specialized speakers (or hi-end HiFi systems) are disposed in endpoint positions in the endpoint environment to correspond to the fixed positions where a plurality of musical instruments are located in the initial environment.

Through the first form of EM, a show may be synchronously broadcast in an endpoint environment different from the initial environment, or replayed in a same environment at any time after real-time show.

The second form of EM: For EM of synchronous sounding bodies all or partially in motion Based on the foregoing first form of EM, the second form of EM uses robotics technology on the basis of existing speakers, or installs existing speakers on motor-controlled guide rails in a slidable manner. In this way, the speakers may move on the guide rails along the motion loci of corresponding sounding bodies recorded in the motion state files.

For example, the sound simulation devices are a kind of speaker robots; each of the speaker robots comprises robot wheels at the bottom of the speaker robot and robot arms at the top of the speaker robot; speakers are disposed on the hands of the robot arms. During audio play, the speaker robots move towards specific 3D positions, and adjust the orientations of the speakers based on stored information of audio tracks.

Step S2 further comprises: the speaker robots move along the motion loci of corresponding sounding bodies recorded in the motion state files.

Here, motion state files may be video files, or recorded coordinates of sounding bodies in the initial environment. Here, motion state files are recorded by a motion tracking device, which are connected to a plurality of sound simulation devices in a communication manner;

The adoption of speakers moving on a guide rail is a way of replaying recording in low cost, but the effect of replayed recording is not satisfying.

During replay, these speaker robots need to cooperate with each other to avoid mutual collision. When considering avoidance of collision among the speaker robots, every speaker robot should reduce its impact on the overall effect of recording replay. Another approach is engaging the speaker robots to minimize the impact of collision of speaker robots on the effect of recording replay.

In an alternative practical application of speaker robots, speaker robots may move on the stage like singers, or wave hands to fans like singers.

In an alternative practical application of speaker robots, as musicians typically will dance, or slightly shake their bodies during performance, the speaker robots will shake accordingly during recording. During replay of recording, the speaker robots will shake in a same way, too. These speaker robots are also called Dancing Robotic Speakers (DRS).

Speaker robots may have any appearance, for example: a common speaker, or an animal, or a conventional humanoid robot. A combination of different appearances may be simultaneously applied in the appearance design of a speaker robot.

The third form of EM: For EM of asynchronous sounding bodies

Supposing some or all of the sounding bodies are performed in different time during recording, the existing music product workshop converts audio tracks into EMX files; the music product workshop also sets virtual position information and sends the virtual position information to the endpoint, audio may be replayed in the endpoint. Only time-shift transmission might appear in this form of EM. Here, EMX is a file format only containing EM audio data.

The third form of endpoint has the following features:

1. The endpoint is an endpoint environment suitable for audio style;
2. The endpoint comprises sound simulation devices for simulating initial sounding bodies; for example, the endpoint comprises hi-end HiFi systems and hi-end speakers, or comprises HiFi systems and specialized speakers suitable for a specific vocal range;
3. Every sound simulation device is disposed in an endpoint position in the endpoint environment to correspond to the fixed position where the sounding body is located in the initial environment.

The fourth form of EM: For EM of a plurality of free sounding bodies

Based on the foregoing first form of EM, second form of EM and third form of EM, the fourth form of EM requires speakers have the following features:

1. Speakers can move (including movement, fast movement and flight); the speakers will take safety precautions during motion to avoid injuring or damaging any object, animal, plant for human. When music sounds, the speakers can dance with beats. As long as the motions of the speakers are safe, there is no limitation to the moving speed of the speakers in a hearing range. The time delay speed of sound wave transmission in the air will be compensated, too.
2. The speakers move within a predetermined physical boundary. If speaker robots used as speakers are a part of an EM system, they can return to their initial positions of motion all the time. Here, there is no limitation to the range of physical boundary of the endpoint.
3. The EM system is reconfigured to make the audio tracks in every speaker replayed in another speaker.
4. The volume of every audio track is adjustable, from 0 to maximum.
5. An EM system or online Internet service is adopted to modify sound quality or enhance sound effect, for example, perform reverberation and delay on the basis of every audio track.
6. Configuration of audio tracks of speakers, speaker position, speaker orientation and angle, speaker motion, dancing of speakers in music, speaker volume and speaker sound modification are decided by the following factors:
   a) Physical constraints—endpoint type, size and space; type and quality of every speaker;
   b) Thinking of creators of initial music;

c) Music style and conception;
d) Recommendation of global service center of EM;
e) Recommendation of social network of EM fans;
f) Position, orientation, mood and internal condition of audience;
g) Desire of audience for creating acoustic images for stereo audio tracks and surround audio tracks;
h) Predetermined program themes of software in EM replay system;
i) Deeply thought or emotional decisions of audience.

7. Synchronous replay with other EM systems—the synchronous replay of this EM system and other EM systems is implemented based on simultaneous server or information transmission among EM systems connected through a computer network.

Further Discussion on EM

Intelligent Volume Control

By adopting embedded Linux computer sensors of speakers, an EM system can calculate sound volume in an endpoint. When the volume is too large, the EM system can issue a visual alarm and automatically adjust the volume of all speakers to a safe volume level in a balanced way.

Audience Position

The use of EM has no limitation to sites and audience of replayed EM; however, as long as the people are not many, there will be a guide so that every audience can listen to EM with satisfaction; audiences won't use their bodies or other objects to block other audiences from listening to EM.

When two or more audios are simultaneously replayed for different audiences in a same EM system, the speakers separately playing these two or more audios will be separated from each other.

Prior art (such as: surround sound system) will require audiences be in a specific area; more strictly, a hi-end HiFi system requires audiences be in specific positions (i.e.: King Seat); not like these techniques, an EM system allows audiences to be in any position inside or outside a speaker area. When sound simulation devices are speaker robots, the speaker robots may be deployed automatically so that audiences can hear optimum sounds, or the speaker robots have a wide listening angle. In this case, audiences may sit, stand or walk among speakers. Audiences may also put their ears close to the speakers, thereby hearing louder and clearer audio tracks. For example, they can hear details of the audio tracks of singing or violins. Audiences in a position far from speakers can also hear sounds in high quality. The design of speakers caters for audience positions and makes speakers have a wide listening angle. The listening angle of speakers may be 360° of spherical.

The present application does not set any limitation to how to establish an auditory sensation area (i.e.: the area of audition positions), but it puts forth an example: in an auditorium, the auditory sensation area is the public area or bedroom of the auditorium. All the audiences are in the middle of the auditory sensation area, and listening angle of every speaker is 360°. Under this setting, when speakers play recorded EM, people in different positions of the auditory sensation area will hear different sounds, similar to the experience of listening to EM and the experience of audience walking on seaside or a busy business center. Further, when a symphonic band plays classical music, EM can also allow audiences to pass through the band; or EM can also allow audiences to put their ears close to singing simulation speakers, thereby audiences can listen to all the details of singer's sounding.

However, the foregoing setting must suppose audiences are all in an audience orientation with an optimum listening effect. Audiences may also hear the best sound quality with the help of professional devices.

Edition

The first version of EMX file format is similar to MIDI file format. Main difference between EMX file format and MIDI file format: EMX file format is designed for a wide range, not only caters for the needs of music creators for recording, edition and listening and the need of audiences for listening, but also enables audiences to have the ability of recording and edition. Another main difference between EMX file format and MIDI file format: EMX file format allows anybody to modify an audio track, while other audio tracks remain unchanged.

Everybody can adopt EMX file or EMVS file to modify any audio track and save the modified audio track result in another EMX file or EMVS file, or in an existing file format of WAV or MP3. EMVS is a file format containing EM audio data and video data. The modified audio track result may be a read-only file or an erasable file. Through this saving design, everybody can easily add, delete and modify the audio tracks of EMX files. Therefore, by providing audio edition function for general people, EM opens a new epoch of music production. In theory, there is no limitation to the quantity of audio tracks in an EMX file. However, a very large EMX file can be replayed only in a very large EM system set in an endpoint, or by using a cloud server running in the endpoint.

Initial music creators can protect all or part of the created music data by applying EM tools, EMX file format and copyright protection of EM system to make the music data unmodifiable after release.

Further, by taking advantage of the operating features of online social network and virtual team, EM enables musicians with different gifts to work together and create an EMX file at an international view of angle.

According to the features of EMX file format, in this embodiment, an EM system further comprises a sound modification device connected to some or all of a plurality of the microphones in a communication manner and intended to modify the sound quality of audio tracks respectively recorded by some or all of a plurality of the microphones or enhance the sound effect of the audio tracks respectively recorded by some or all of a plurality of the microphones; the sound simulation devices corresponding to some or all of a plurality of the microphones are connected to the sound modification device in a communication manner and intended to synchronously play the corresponding audio tracks modified by the sound modification device.

Comparison with Prior Art of Surround Sound

Based on EM, in an EM system, as long as the position setting of speakers meets the requirements of surround sound for speaker positions, any type of speakers can be used as surround sound speakers to play surround sound (including 5.1 surround sound, 6.1 surround sound and 7.1 surround sound). Anyway, universal speakers are recommended, while special speakers are not suitable to play surround sound, and the speaker robots that can read motion data only also cannot be used.

The EM system has a predefined surround sound replay mode. This surround sound replay mode is intended to produce sounds on every speaker based on the type of surround sound technique. EM applies existing surround sound technique to decode and replay surround sound audio data.

All speakers are connected preferably via WiFi.

One kind of EM system applies simple speaker robots. By pressing down a button, [Establish speakers in a 5.1 surround sound mode⌋ button for example, the speakers will automatically conduct physical movement based on preferred surround sound positions and actual endpoint structure. After the use process of all speakers is over, the speakers will return to initial positions. Here, a kind of speaker robots having robot wheels and vertical rails, connected to an EM system via WiFi and internally installed with soft robot musician software—speaker robot model A are a kind of speaker robots for the purpose of surround sound. However, the present application does not limit the use of speaker robot model A to surround sound.

Relation Between EM and MIDI

MIDI is built in an EMX file. For example, music producers or audiences can map universal MIDI musical instruments onto specialized speakers. This logical decision is made based on the use effect of musical instruments. Mapping musical instruments on to specialized speakers is an appropriate mapping method, for example, it is most appropriate to map MIDI triangular grand piano (#1) onto an automatic piano.

In EMX files, the data about use of audio tracks of motion data adopts an existing MIDI file format, rather than a standard digital audio data format. In other words, initial audio data cannot be transmitted in a specific sound channel, but the operations in input devices can be captured and saved in an MIDI file format.

The replay of EM may be realized through the following two ways: firstly, through an MIDI rendering module of the EM system, MIDI data is converted into audio data, and this audio data is played by a universal speaker; secondly, MIDI data stream is provided for a speaker robot to make the speaker robot directly replay it. The use of an automatic piano is a good example explaining how a speaker robot receives MIDI motion data from an EM system and how the speaker robot converts the MIDI motion data into sound played in an endpoint.

Further, existing MIDI musical instruments support EMX file format. In this way, endpoint users can use MIDI musical instruments to produce and listen to music.

WAM (Wide Area Media) Replay

The main purpose of WAM replay is to selectively use it in sub-devices to vividly replay EM.

Below we describe a main form of WAA (Wide Area Audio) replay: by selecting some or all speakers in an EM system, the users can replay audio on these speakers in the following ways:

1. All speakers play a same audio track, i.e.: single track.
2. Only the speakers near audience play sound, and all the speakers playing sound play a same audio track, or play different audio tracks relevant with the orientation of the audience. In this way, the EM system can play EMX files or existing stereo on these speakers. Meanwhile, audience can use EM control tools to play an EMX file, and enable every audio track of the EMX file to be replayed on one or a plurality of speakers.

WAV file is played in a similar way.

Audio and Video Broadcasting

EM broadcasting is a form of audio and video broadcasting:

1. EM broadcasting covers the earth and other appropriate planets, Mars for example.
2. The maximum transmission lag time between two speakers of a same EM system is 60 s. Transmission lag time is the difference between the time when an electronic signal is generated on a recording device and the time when a speaker sends a sound wave.
3. Safe broadcasting: during transmission of data between recording devices in an endpoint and all speakers, data modification is strictly forbidden, with only one exception, which is modification based on the desire of the audience. For example, the audience decides to adopt modified rented sound provided by a cloud server in broadcasting feed. The requirements for safe broadcasting will be marked in a digitalized way by a public key encryption module.

The present application covers the basic elements of broadcasting, but it is not limited to the broadcasting features mentioned here; a broadcasting-related area will enhance existing broadcasting technology to provide EM audio, cable TV network for example.

Based on the design that audio data is continuously input to EM data subjects, EMX file is a use method that satisfies data stream. Therefore, EM system can download EM data subjects while replaying sound. It is similar to most existing Internet video data stream techniques. The bandwidth of EM data stream should be lower than the bandwidth of video data stream, so the play of audio data stream with an EMX file may be realized by prior art.

The data stream of EMVS files suitable for video broadcasting and the data stream of EMX files adopt a same playing method.

Audio and video broadcasting can be realized by a video server in a way of substituting video files with EMX files/EMVS files, and adds a client software module to the EM system. In this way, this client software module may receive EM data subjects, decode and render the EM data subjects, distribute audio tracks and realize audio replay on speakers.

Visual Effects and Entities of Regular Speakers, Speaker Robots or Universal Robots All speakers can be connected to an EM system.

However, the speaker robots introduced by the present application have more features, but the features must observe the following rules:

1. The speaker robots can be made into any form.
2. In order to avoid damage, abuse or misuse of speaker robots, during outdoor use and in a dark environment, speaker robots must emit obvious visual signals to mark their existence. For example, a speaker robot may show a slogan ⌈audio replay is going on⌋ or ⌈the fourth form of EM⌋, to inform its existence and position to people nearby and make people know from where and why they hear sounds. When the speaker robot begins to show a slogan, the slogan shall be eligible enough. Later on, this slogan may maintain a same brightness as adopted when the speaker begins to show it, or may be slightly darker, but the brightness of the slogan shall be resumed to initial brightness once every at least 10 min.

Robotic Furniture

An EM system also comprises robotic furniture. A ROBO chair is a chair that is provided with high-capacity batteries and has a robot wheel on every leg; the high-capacity batteries provide electric energy for motion of the ROBO chair; the ROBO chair is similar to a speaker robot; one or a plurality of audiences may sit in the ROBO chair. The ROBO chair can move according to the commands of the EM system.

Similarly, a ROBO stand is a standing frame suiting the general purpose of robots. The ROBO stand is mainly used to hold up a video-playing display screen (such as: 55-inch LED TV screen) or projection screen.

The EM system considers the ROBO chair as a center and determines the command and control signals sent to the ROBO chair, the ROBO stand and speaker robots through the relative positions among the ROBO chair, ROBO stand and endpoint environment and between speakers.

Specifically, in this embodiment, only the following three of the relative positions among ROBO chair, ROBO stand and endpoint environment and between speakers need to be determined:

a) 3D relative position between ROBO chair and endpoint environment;
b) 3D relative position between ROBO chair and ROBO stand;
c) 3D relative position between ROBO chair and speaker robot.

Through synchronously moving the ROBO chair, ROBO stand and speaker robots in an endpoint environment, and calculating and maintaining the relative positions among the ROBO chair, ROBO stand and speaker robots in the endpoint environment, a virtual ⌈house motion effect⌋ may be created. This house motion effect depends on the stabilization of moving ROBO chair, ROBO stand and speaker robots in the endpoint environment, floor type, wind, mechanical accuracy and other factors; the mutual cooperation of these factors may improve the house motion effect to the best.

A same method is also adopted outdoors. For example, when an EM system slowly passes through a forest, users may experience an effect of ⌈forest motion⌋.

In an alternative embodiment, the ROBO chair, ROBO stand and speaker robots in the endpoint environment may move freely; this free motion must follow a basic principle: the ROBO stand is not used, while users want to obtain ⌈house (or endpoint environment) motion effect⌋; the ROBO chair and speaker robots must abide by the speaker positioning and hearing rules of a same EM.

In an alternative embodiment, Walking Audience Listening Technique is adopted to move the ROBO chair disposed among speaker robots in a fixed manner or to maintain the relative motion relations between audience and speaker robots.

Similarly, robot motion way and remote control ability are extended to other furniture in a similar way; the furniture includes without limitation:

Tables; lamps.

Wearable EM Product

Palm Speaker

Speakers may be installed on clothes. There are many artistic and fashionable designs for this setting.

Palm speaker is a wearable EM product. It comprises a flat and round Bluetooth speaker disposed on the palm of a glove, as shown in FIG. 1. Meanwhile, JBM2 software version runs on user's smart phone. JBM2 is a device installed in a speaker and having computing power and an I/O device, such as: RJ45 LAN port, and audio output DAC module.

Inside every glove there is a round LED and gyroscope. The gyroscope is intended to detect if the hand is raised or put down, or to indicate the orientation of the palm.

When the user has a Bluetooth headset, the audio output result of JBM2 will be mingled in the sounds of the user. The sounds of the user will be played in the palm speaker.

IEM (Integrated EM) Product

IEM Main Product

The purpose of the IEM main product is to realize all functions of the EM under the present application.

Below we introduce a recommended product, but the products under the present application are not limited to the following product; all the modifications or changes made according to the ideas of the present application shall be within the protection scope of the present application.

The IEM main product is an electronic product, comprising built-in CPU, memory and storage and intended to control the hardware system of EM; the hardware system is installed with a Linux system, and EM software to control EM. The IEM main product further comprises a WiFi communication module, for WiFi communication connection with LAN. The IEM main product also has an internal compartment. In the compartment, at least four speakers mounted on a rail are disposed.

The IEM main product has the following main features:

It can play EM audio;

The positions between speakers vary with the types of played EM audio.

Figure 2:
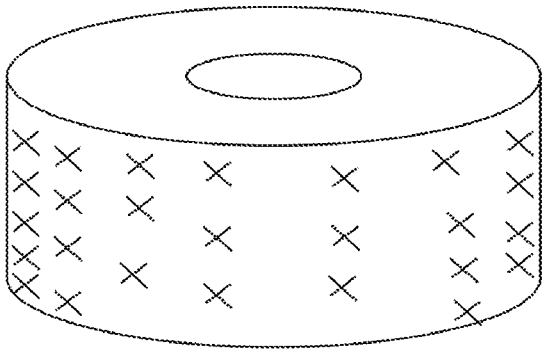
FIG. 2 is a schematic view of an integrated EM (IEM) main product in an embodiment of the present invention.

Refer to FIG. 2, the IEM main product looks like a protective rail to avoid injury of human and animals during motion of speakers, particularly during audio replay of EM, or fast motion of speakers.

The First Form of IEM Product

Figure 3:
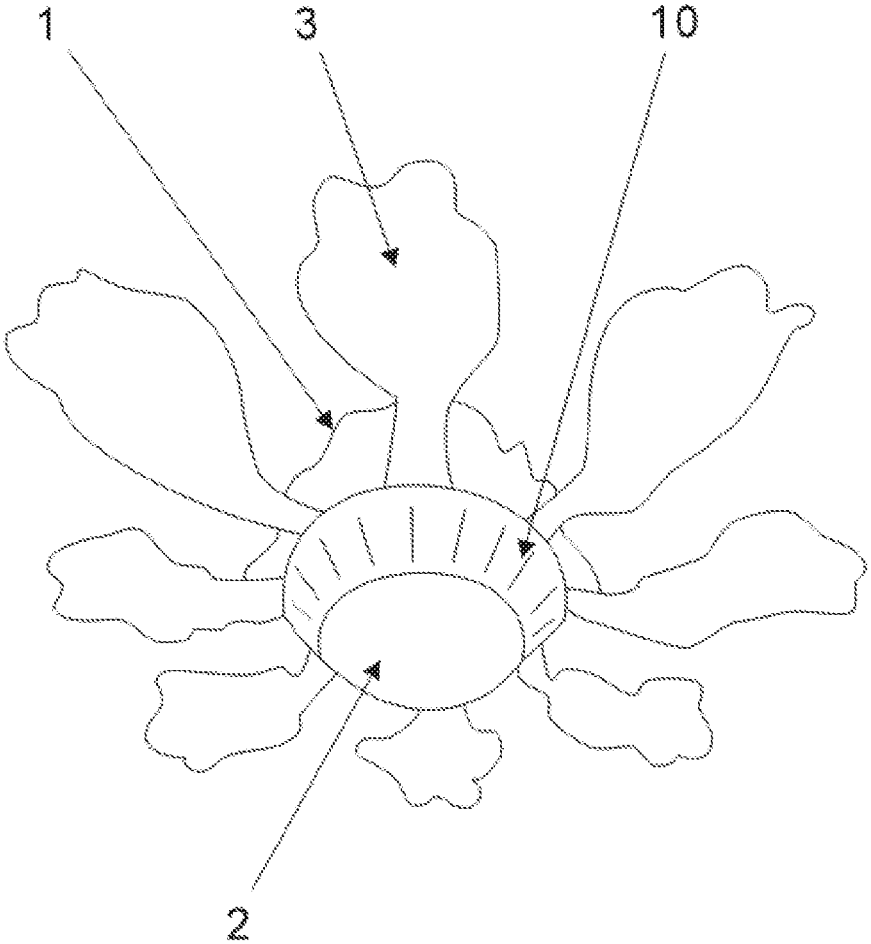
FIG. 3 is a schematic view of the first form of IEM product in an embodiment of the present invention.
Figure 4:
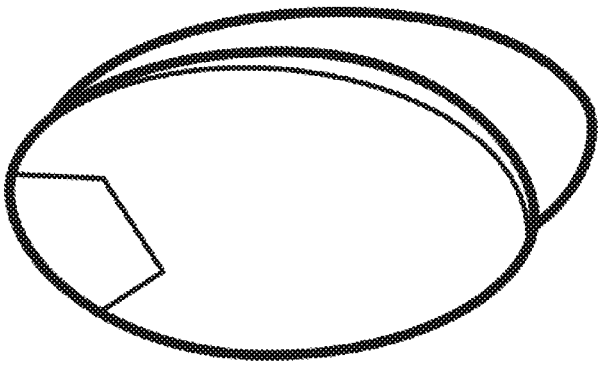
FIG. 4 is a schematic view of a ceiling bracket of the first form of IEM product as shown in FIG. 3.

Based on IEM main product, the first form of IEM product has the following additional features:

1) FIG. 3 shows the first form of IEM product. The first form of IEM product 10 comprises a ceiling bracket 1 and a robot. The ceiling bracket 1 is mounted to ceiling in a fixed manner. Except the ceiling bracket 1, other part of the first form of IEM product 10 is a robot. The robot is disposed on the ceiling bracket 1 in a detachable manner.
2) When the ceiling bracket 1 is mounted, it can be lengthened, thereby adjusting the height of the robot. The height of the robot (i.e.: the height from floor to the robot) can be automatically adjusted. The height of the robot is 1 m~height of the ceiling. Therefore, an audience can adjust the height of the robot to listen to sounds horizontal with him/her.
3) When the robot is removed from the ceiling bracket 1, the bottom cover of the robot is removed to show the robot wheels 2 at the bottom of the robot. The robot can be used indoors or outdoors. Through remote control software in his/her mobile phone, a user can order the robot to play audio, or move, or move freely, or observe the orders of the audience all the time. Visual signals can be transmitted to user's mobile phone and played on this mobile phone.
4) A plurality of electric bulbs 3 are disposed on the robot in a surrounded manner; the normal lighting of these electric bulbs 3 may be controlled through ordinary wall switches or through a mobile phone (software run in the mobile phone). During audio replay, users may also, for the purpose of entertainment, make a plurality of the electric bulbs 3 flash in different colors.
5) When the ceiling bracket 1 is removed, it is as shown in FIG. 4. It can work like a conventional lamp and controlled by a conventional wall lamp or a mobile phone (software run in the mobile phone).

The Second Form of IEM Product

Figure 5:
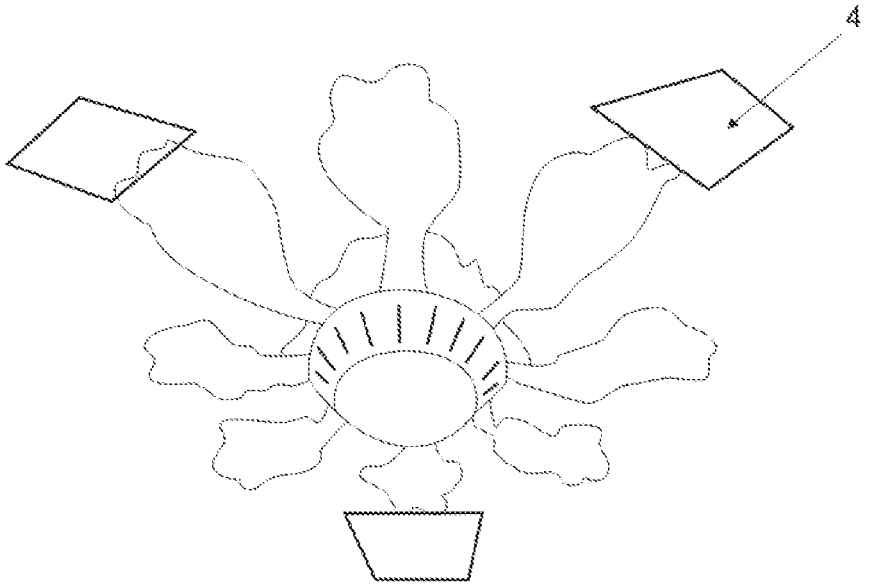
FIG. 5 is a schematic view of the second form of IEM product in an embodiment of the present invention.
Figure 6:
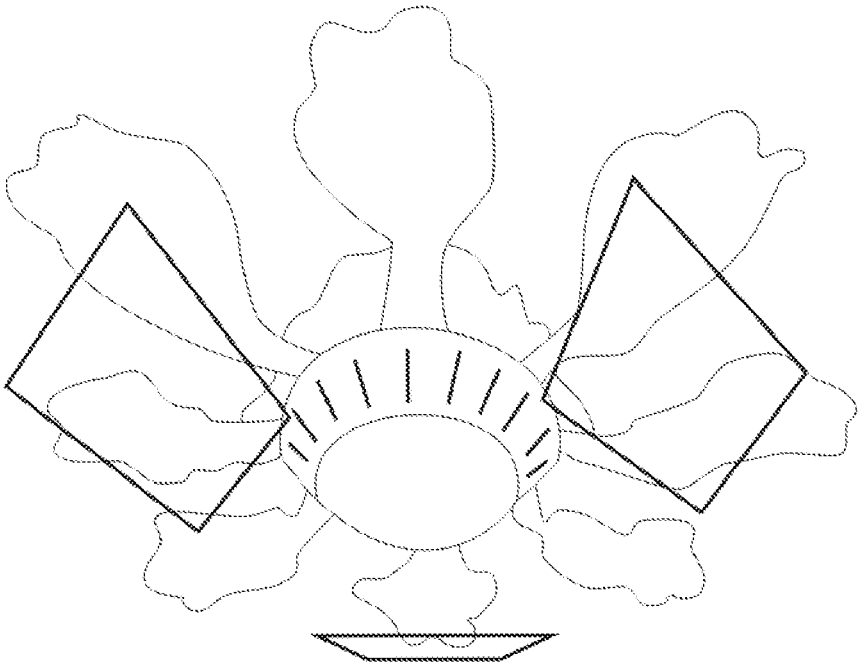
FIG. 6 is an alternative schematic view of the second form of IEM product in an embodiment of the present invention.

Based on the first form of IEM product, the second form of IEM product has the following additional features:

1) One or a plurality of transparent display screens 4 on robot arms are installed on a ceiling bracket, as shown in FIG. 5.
2) Based on the result of collision detection, one or a plurality of display screens 4 can be adjusted upwards or downwards; when a display screen 4 is being used, it will be adjusted upwards, as shown in FIG. 6. Audible alarms and LEDs are disposed on one or a plurality of display screens 4.

3) The display screens 4 are connected to JBOX-VIDEO in an output manner. JBOX-VIDEO is just software running in a computer having the display screen 4.
4) Conventional display screens can replace these transparent display screens 4.

The Third Form of IEM Product

Figure 7:
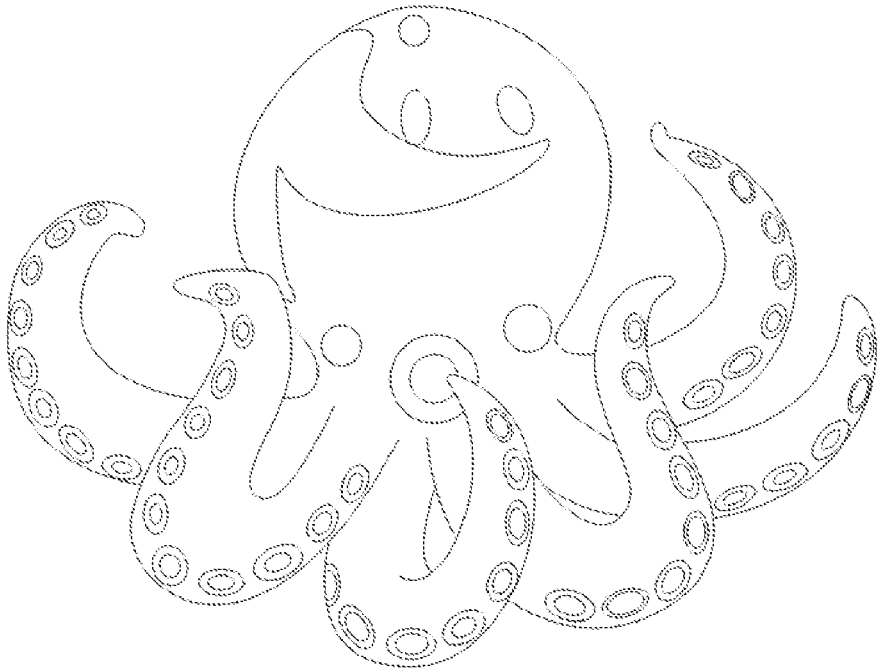
FIG. 7 is a schematic view of the third form of IEM product in an embodiment of the present invention.

Based on IEM main product, the third form of IEM product has the following additional features:

1) The third form of IEM product is a speaker robot. The speaker robot has robot wheels or other components that can make the robot move;
2) The third form of IEM product has a lovable appearance, as shown in FIG. 7. Its appearance is an octopus;
3) All speakers are installed at the terminals of the robot arms;
4) It bears some or all of the features of the first form of IEM product and the second form of IEM product.

In order that the third form of IEM product has certain visual effect, the following means may be adopted:

1) Electric bulbs, LEDs or laser lamps are installed on the third form of IEM product;
2) Based on the shape of the third form of IEM product, LEDs are installed all over the third form of IEM product;
3) A flat-panel LED display screen is installed on the third form of IEM product;
4) A JBOX-VIDEO product near the third form of IEM product can be used to control the flat-panel LED display screen;
5) A mobile device near the third form of IEM product can be used to control the electric bulbs, LEDs or laser lamps and/or flat-panel LED display screen on the third form of IEM product.

New World of EM Music—New Endpoint Environment, New Musical Instruments and New Music Presentation Mode Probably it is the first time in human history to create EM music in a new EM use mode. People may create a new, innovative, revolutionary and elaborate world. This new world includes:

1) A new endpoint environment—this endpoint environment spans a vast geographic area, for example: 100,000 speakers are used in a garden of 50,000 $m^2$, and every speaker plays an audio track;
2) New musical instruments—through sounding bodies and EM technology, a new artistic experience is created for the people. For example, there are 5000 glass columns; every glass column is 10 m high and filled with water and has a speaker at the top; all the speakers are connected to an EM system in a communication manner; each column is responsible to generate the sound of a unique chord of a harp. This endpoint environment is intended to replay MIDI audio tracks of EMX/EMVS files, or connect an electronic harp; when a musician plays a harp, the new endpoint environment will synchronously make sounds. Here, the electronic harp is a conventional harp and all of its chords are connected to microphones.
3) New music presentation mode—all possible and accepted sounding bodies are selectively used in an endpoint environment. For example, in a concert, audiences wear their wearable EM devices (WEM), and conventional speakers are arranged on the stage of this concert; every conventional speaker has a flying robot, for flying the conventional speaker; speaker robots are also distributed around the concert; some of the speaker robots move around audiences. During the concert, musicians sing songs and play music, interact with audiences, hand over musical instruments to audiences, let audiences hold up their hands, and make their WEM a part of the EM system, and a part of the musical instruments in the concert. Audiences may sing songs through WEM. All in all, musicians may freely utilize all resources to push ahead the concert and have audiences involve in the concert in an EM mode.

Technical Details

Main Functions of EM System

1) Enumerate all speakers;
2) Acquire registration information of every speaker and import it to a real-time database;
3) The speakers make sounds synchronously;
4) Realize play, stop and other commands and controls of JBM2 devices;
5) Provide the following information to respond to the inquiry information from a client of which identity has been authenticated:
   a) A full list of all speakers, as well as tasks of every speaker;
   b) Type, vocal range, endpoint position, state and other information of single speakers.

Synchronize the Sounds of Speakers—Algorithm

In order to weaken audio difference among different audio tracks, the time difference between two different speakers playing an audio track with different single nodes shall be less than 10-100 ms.

Many methods can solve the foregoing problem, including synchronizing method based on message transfer and polling. However, these methods make the time difference between any two different speakers playing an audio track with different single nodes fall in a range of 100-500 ms.

The present application provides a preferred method to solve the foregoing problem. In this method, every speaker of embedded Linux device is synchronized with a same Internet time server at least once a day, and all synchronizing activities (such as: synchronizing at the beginning of a replay process) shall be based on two factors. One is a command from the EM system, which contains a target operation timestamp in a future time; the other is embedded Linux clock time, of which format is OS epoch time.

Supposing the Internet communication among users is delayed, this method of the present application reduces the time difference between any two different speakers playing an audio track with different single nodes to not more than 50 ms. Between an embedded Linux device and time server, there is a very small turnover period. This assumption was true on all Internet terminals in the world in 2014. In the future, the improvement of router technology and the replacement of electric cables with optical cables will further shorten the turnover period, thereby completely eliminating the problems of time difference of audio tracks. Installing a miniature atomic clock in the EM system is a solution in the future.

In order to control a JBM2 device, the following steps are adopted:

In an EM system:

If a user pressed down a play button, 『play time』 is 2017-03-17_10: 23: 59.001(OS epoch time, accuracy 1 ms) may be obtained;

Then the information of ⌈start playing at 『play time』⌋ is sent to all speakers in this EM system;

On a JBM2:

Based on the received information of ⌈start playing at 『play time』⌋, time in this information is obtained, the local time on the JBM2 device is checked, and an action is taken when the local time reaches 『play time』.

Attention:

Starting playing a list needs a process, for example: the process of using Fork;

Internet communication observes TCP/IP. In this way, we may secure high-quality information transmission.

Synchronize the Sounds of Speakers—Operating System (OS) and Multitask Consideration Most modern calculator operating systems are multitask systems. For various reasons, the run programs of speakers currently are independent of other programs. As a result, the starting time of sound play of each speaker is uncertain.

The time difference between any two speakers replaying a same EM audio is not longer than 20 ms, but Sync Time Period of any two speakers may not exceed 10 s.

In order to meet the foregoing requirements, the present application adopts the following two methods:

Method 1: Use hardware and OS with same resources, configuration, run program and specification;

Method 2: Adopt ⌈Lock—Report—Calloff—Atomic—Transaction⌋ algorithm

Evaluation:

1) Customers buying two or more pieces of same hardware may adopt method 1;
2) Customers adopting mixed hardware (combination of iPhone and computer for example) may run into the problem of synchronization. A same problem of synchronization also appears in the following endpoint: different objects in the endpoint attempt to play same music; these different objects include refrigerator, tea cup and mobile phone. Method 2 may be adopted in this case;
3) Customers adding new hardware to old hardware will also encounter the problem of synchronization because although old hardware is mutually identifiable, new hardware may be more advanced, and new hardware and old hardware are different in both hardware specification and software specification. Method 2 may be adopted in this case.
4) An integrated system does not have the problem of synchronization.

"Lock-Report-Calloff" Processing Process—Algorithm

As for a JBM2 device responsible for the task of replaying a same EMX file, ⌈Lock-Report-Calloff⌋ processing process includes the following steps:

1) Adjust volume to 0%;
2) Limit the audio processing module to an only purpose;
3) Check local clock in real time for the target replay time; import an audio data block into audio hardware when the target replay time arrives;
4) Determine and report to the EM system the actual replay time of the audio data block by sending the actual replay time of the audio data block to the EM system;
5) Wait for result response of the EM system;
6) If this result response is ⌈Calloff; re-limit the audio processing module in terms of the limited starting time of the audio processing module⌋, then replay is stopped and Step 2 is returned to;
7) Straightly adjust volume to 100% in 7 s.

In an EM system:

1) Wait for and collect all reports of every speaker in the speaker group;
2) Compare all the reports to ascertain if the speaker group meets the requirements for time difference;
3) Send the information of Step 2 to all devices in the speaker group. If any speaker does not meet requirements, it will send ⌈Calloff; re-limit the audio processing module in terms of the limited starting time of the audio processing module⌋. Otherwise it will issue ⌈successful⌋;
4) If any speaker does not meet the requirements, Step 1 will be returned to.

Evaluation of the algorithm

1) In a small system, less than 50 units of the resources of JBM2, basic hardware, network and software are sufficient;
2) In a large system, 100,000 units of the resources of JBM2, network and EM system must be:
   a) Sufficient network resources;
   b) A network with low response delay, thus avoiding prolonged ⌈audience wait time⌋;
   c) Sufficient processing resources in the EM system, which are intended to synchronously send and receive tremendous communication information, for example, the processing resources have 100,000 units.

Broadcasting of a Plurality of RTMP (Real-time Message Protocol) Data Streams

Based on RTMP of Adobe Corporation, EM broadcasting station provides EM audio with RTMP. One RTMP data stream is correspondently played on one audio track.

Local EM system adopts stream media to decode audio data and synchronizes the replay processes of all speakers by a synchronizing method.

Station Master List File Format is M3U file format.

EM system will download M3U station list on the pre-configuration central server; a selection interface is provided for users to make for selection of M3U stations. Later, the EM system is connected to M3U stations, and begins to synchronously download the content of all audio tracks by using RTMP. Then, decoding, synchronizing and replay are conducted on the speakers of the EM system.

Detail Design of a Speaker Robot—a Universal Speaker having Robot Wheels and Vertical Rails, Connected to an EM System Via WiFi, and Internally Installed with Soft Robot Musician Software, i.e.: Speaker Robot A Based on universal speakers, this speaker robot further comprises:

1) A matrix:
   a) The matrix comprises high-capacity batteries, which can be charged repeatedly through its docking station) or by connecting to a power source;
   b) The matrix has built-in JBM2, which is powered by high-capacity batteries. The JBM2 is also connected to an EM system via WiFi;
   c) Robot wheels are disposed at the bottom of the matrix and powered by high-capacity batteries. The control signal lines of the robot wheels are disposed on the back side of JBM2;
   d) The matrix further comprises an optical sensor disposed at the bottom of the matrix and intended to identify rail color;
   e) The matrix further comprises a speaker received in the matrix. The speaker is connected to JBM2 via audio signals. A single-track speaker line is connected to the speaker;
   f) The matrix further comprises sensors intended to detect blocking objects around the matrix.
2) A vertical robot arm is disposed on the matrix. A speaker is disposed at the top of the robot arm. A servo mechanism is disposed in the rear part of JBM2. The vertical robot arm may have a motion platform and consist of two parts, or a simple vertical rail.
3) An additional software module built inside JBM2 is intended to identify the rail signals at the bottom of this speaker robot; determine which part of the speaker robot moves, as well as the vertical height of the speaker based on decoded position and direct information from EMX file. EMX file information is mapped with robot posture to imitate the positions and directions of initial sounding bodies.

4) The software module will also execute collision avoidance from time to time.

Relevant Accessories

1) Docking station: After the use of a robot is completed, it can be put back to the docking station; the docking station is an initial position of the robot. The docking station is used as a battery charger and can automatically charge the high-capacity batteries of the robot till they are fully charged.

Design of Soft Robot Musician Software

The soft robot musician software has the following features:

1) All audio tracks must be recorded under a same beat;
2) At least one reference MIDI audio track with music beat number (such as: song of 4/4 beat) is available;
3) Reference pitch—accurate pitch tuning data is the tuning usable in soft robot musician software;
4) Set keys and chords in EMX file.

When all of the foregoing conditions are possessed, the user can selectively initialize a soft robot running in a built-in virtual machine of Linux system for every JMB2.

The user can initialize one or a plurality of soft robots corresponding to one sounding body, and send one or a plurality of the soft robots to speakers, but in order to realize maximum motion resilience, only one soft robot is distributed to a speaker. The user can initialize or selectively use another soft robot based on same soft robots with different parameters. For example, the two soft robots of Fender-Stratocaster sounding body are distributed to two speakers; one of the speakers is for playing chord, and the other is for playing solo. An additional soft robot of Only Bird sounding body of major triad is distributed to one of the speakers.

Every sounding body adds reference pitch, beat number, beat, key and existing chord to a corresponding artificial intelligence (AI) module, and decides the sounds that are made to suit the existing chord. The sounding bodies may give out beats of percussion instruments, bird song or emotional expressions, as well as previous play and next play, refer to percussion tempo and use various factors of AI.

Entertainment

Watching motions of speaker robots won't delight audiences, but adding optical devices and LCD displays to every speaker robot may make the motions of the speakers more entertaining. For example, LED bars at simple volume level, or laser gun show at a simple level can be added to moving speaker robots.

Detail Design of Robotic Furniture

When a ROBO chair bears the features same as those of a speaker robot A (a universal speaker having robot wheels and vertical rails, connected to an EM system via WiFi, and internally installed with soft robot musician software), it is used to replace an ordinary speaker. The ROBO chair may be positioned simply by trails, or by reference points on the rear wall and in a specific height. For the sake of safety, no robot arm is disposed on the ROBO chair to raise the ROBO chair. Two speakers rather than one are disposed on the ROBO chair; one of the two speakers is on the left of the ROBO chair, and the other is on the right; when an audience sits in the ROBO chair, two speakers directly face the two ears of the audience.

The ROBO chair has one, two or a plurality of seats; it may adopt different designs, materials and types. It also has a function of massage. However, all the factors must maintain balanced with servo torque and noise level decided by moving components, battery capacity and battery service time.

ROBO stand is a standing frame suitable for general purpose, and intended to hold up an LED TV screen; difference between ROBO stand and ROBO chair: ROBO chair may be replaced by ROBO stand, and can firmly and safely hold up effective load during smooth motion.

WAM (Wide Area Media) Replay—Algorithm

1. All speakers of an EM system in LAN are registered. Every speaker is projected onto floor plane at a depression angle. Every speaker is marked;
2. Every speaker of the EM system (speakers, effective marks and volume level) is recorded on the user interface; the user interface may be APP, PC software or webpage of iPad;
3. During EM, needed speakers are provided according to requirements;
4. Hibernate 2 s;
5. Go back to Step 2.

Attention: The communication between EM system and every JBM2 must be based on TCP/IP. It is supposed that links have been established between the EM system and every JBM2. Given that the EM system and all JBM2 are in a same LAN, or are isolated outside Internet, in order to establish links between the EM system and every JBM2, a virtual private network (VPN) needs to be established to conform to TCP/IP.

Structure of EMX Files

An EMS file contains the following information:

File type;

Version number;

DRM (Digital Right Management) information, owner, copyright information;

Audio data;

Positioning information;

Information exclusively for soft robot musicians;

Metadata of audio tracks—information about details of audio tracks: types and detailed models of musical instruments, names of musicians, names of songwriters, names of composers and names of singers, etc.

Stereo coupling relation between audio tracks

According to the foregoing content, the present invention provides an EM playing method, comprising the following steps:

S0) a plurality of microphones corresponding to a plurality of sounding bodies in an initial environment are provided; an endpoint environment of which the type and size correspond to those of the initial environment, and a plurality of sound simulation devices corresponding to a plurality of the microphones one to one and connected to the corresponding microphones in a communication manner; every sound simulation device is disposed on an endpoint position in the endpoint environment to correspond to the position where the sounding body corresponding to the sound simulation device is located in the initial environment; a motion tracking device connected to a plurality of sound simulation devices in a communication manner is provided;

S1) a plurality of microphones synchronously record the sounds of a plurality of corresponding sounding bodies into audio tracks respectively; the motion tracking device synchronously records the motion states of a plurality of sounding bodies into motion state files;

S2) a plurality of sound simulation devices synchronously move in the motion states of the corresponding sounding bodies recorded in the motion state files, and synchronously play the audio tracks recorded by the corresponding microphones respectively, thereby playing EM.

Further, Step S1 further comprises: a sound modification device connected in a communication manner to some or all of a plurality of the microphones, and to the sound simulation devices corresponding to some or all of a plurality of the microphones is provided, modifies the sound quality of the audio tracks respectively recorded by some or all of a plurality of the microphones or enhances sound effect to the audio tracks respectively recorded by some or all of a plurality of the microphones;

Step S2 further comprises: the sound simulation devices corresponding to some or all of a plurality of the microphones synchronously play corresponding audio tracks modified by the sound modification device.

The present invention respectively records the sounds of a plurality of sounding bodies into audio tracks through a plurality of microphones, plays corresponding audio tracks through a plurality of speakers corresponding to the positions of the sounding bodies, thereby playing EM, may reproduce the sounds played by sounding bodies on site and have a very good sound quality effect.

It should be understood that those skilled in the art may make modifications or changes based on the foregoing description. All these modifications and changes shall be within the protection scope of the claims of the present invention.

What is claimed is:

1. An endpoint mixing playing method, comprising following steps:

S0) providing a plurality of microphones corresponding to a plurality of sounding bodies in an initial environment; providing an endpoint environment of which the type and size correspond to those of the initial environment, and a plurality of sound simulation devices corresponding to the plurality of microphones one to one and connected to the corresponding microphones in a communication manner; each of the sound simulation devices being disposed on an endpoint position in the endpoint environment corresponding to the position where the sounding body corresponding to the sound simulation device is located in the initial environment; providing a motion tracking device connected to the plurality of sound simulation devices in a communication manner in the initial environment;

S1) the plurality of microphones synchronously recording the sounds of the plurality of corresponding sounding bodies into audio tracks respectively; the motion tracking device synchronously recording the motion states of the plurality of sounding bodies into motion state files;

S2) the plurality of sound simulation devices synchronously moving according to the motion states of the corresponding sounding bodies recorded in the motion state files, and synchronously playing the audio tracks recorded by the corresponding microphones respectively, thereby playing endpoint mixing;

wherein every microphone is opposite to the sounding body to which it corresponds, and the distance between every microphone and corresponding sounding body is the same;

wherein the sound simulation devices comprise speakers;

wherein the sound simulation devices comprise speaker robots; each of the speaker robot comprising robot wheels at the bottom of the speaker robot, and robot arms at the top of the speaker robot the speakers being disposed on the hands of the robot arms;

the step S0 further comprising providing a robotic furniture; the robotic furniture comprising a movable ROBO chair that can carry audience and a movable ROBO stand holding up a video-playing display screen or projection screen;

the step S2 further comprising: synchronously moving the ROBO chair, ROBO stand and speaker robots in the endpoint environment, and maintaining their relative positions.

2. The endpoint mixing playing method according to claim 1, wherein the speakers are disposed on motor-controlled guide rails in a slidable manner;

the step S2 further comprising: the speakers moving on the rails along the motion loci of corresponding sounding bodies recorded in the motion state files.

3. The endpoint mixing playing method according to claim 1, wherein all speakers are linked together through WiFi.

4. The endpoint mixing playing method according to claim 3, wherein the step S1 further comprises: providing a sound modification device connected in a communication manner to some or all of the plurality of microphones, and to the sound simulation devices corresponding to some or all of the plurality of microphones, the sound modification device modifying the sound quality of the audio tracks respectively recorded by some or all of the plurality of microphones or enhancing the sound effect of the audio tracks respectively recorded by some or all of the plurality of microphones;

the step S2 further comprising: the sound simulation devices corresponding to some or all of the plurality of microphones synchronously playing corresponding audio tracks modified by the sound modification device.

5. The endpoint mixing playing method according to claim 4, wherein the audio tracks recorded by a plurality of the microphones are saved in a format of EMX file.

6. An endpoint mixing system comprising: a plurality of microphones to which a plurality of sounding bodies correspond in an initial environment and which are used to synchronously record the sounds of the corresponding sounding bodies into audio tracks; a motion tracking device for synchronously recording the motion states of the plurality of sounding bodies into motion state files in the initial environment; an endpoint environment of which the type and size correspond to those of the initial environment; and a plurality of sound simulation devices; the sound simulation devices corresponding to the plurality of microphones one to one, connected in a communication manner to the corresponding microphones and the motion tracking device, synchronously moving according to the motion states of the corresponding sounding bodies recorded in the motion state files and synchronously playing the audio tracks recorded by the corresponding microphones, thereby playing endpoint mixing; every sound simulation device being disposed on an endpoint position in the endpoint environment corresponding to the position where the sounding body corresponding to the sound simulation device is located in the initial environment;

wherein every microphone is opposite to the sounding body to which it corresponds, and the distance between every microphone and corresponding sounding body is the same;

wherein the sound simulation devices comprise speakers;

wherein the sound simulation devices comprise speaker robots; each of the speaker robot comprising robot wheels at the bottom of the speaker robot, and robot arms at the top of the speaker robot the speakers being disposed on the hands of the robot arms;

the endpoint mixing system further comprising a robotic furniture; the robotic furniture comprising a movable ROBO chair that can carry audience and a movable ROBO stand holding up a video-playing display screen or projection screen;

wherein the ROBO chair, ROBO stand and speaker robots are able to move synchronously and maintain their relative positions in the endpoint environment.

* * * * *